US009179780B2

(12) United States Patent
Kanthasamy

(10) Patent No.: US 9,179,780 B2
(45) Date of Patent: Nov. 10, 2015

(54) MULTI-LEVEL SOFA HINGE FOR SOFA CONVERTIBLE

(71) Applicant: Lifestyle Solutions, Inc., Fremont, CA (US)

(72) Inventor: Abedan Kanthasamy, Kuala Lumpur (MY)

(73) Assignee: Lifestyle Solutions, Inc., Fremont, CA (US)

( * ) Notice: Subject to any disclaimer, the term of this patent is extended or adjusted under 35 U.S.C. 154(b) by 0 days.

(21) Appl. No.: 14/731,905

(22) Filed: Jun. 5, 2015

(65) Prior Publication Data

US 2015/0267448 A1 Sep. 24, 2015

Related U.S. Application Data

(63) Continuation-in-part of application No. 14/531,667, filed on Nov. 3, 2014, which is a continuation-in-part of application No. 12/860,965, filed on Aug. 23, 2010, now Pat. No. 8,875,321.

(51) Int. Cl.
*A47C 17/175* (2006.01)
*A47C 17/17* (2006.01)

(52) U.S. Cl.
CPC ..... *A47C 17/1756* (2013.01)

(58) Field of Classification Search
CPC .. A47C 17/17; A47C 17/162; A47C 17/1756; A47C 17/00; A47C 17/175
USPC ..... 5/12.1, 16, 37.1, 57.1; 16/324, 326, 16/344, 352; 297/354.12, 354.13
See application file for complete search history.

(56) References Cited

U.S. PATENT DOCUMENTS

| | | | | | |
|---|---|---|---|---|---|
| 696,671 | A | * | 4/1902 | Gay | 16/347 |
| 702,304 | A | * | 6/1902 | Hulse | 16/344 |
| 702,958 | A | * | 6/1902 | Jones | 5/37.1 |
| 711,715 | A | * | 10/1902 | Clark | 16/344 |
| 2,324,675 | A | * | 7/1943 | Burton | 5/37.1 |
| 2,343,642 | A | * | 3/1944 | Burton | 5/37.1 |
| 2,573,073 | A | * | 10/1951 | Vale | 297/294 |
| 2,601,683 | A | | 7/1952 | Bebry et al. | |
| 2,625,693 | A | | 1/1953 | Raginsky | |
| 2,679,892 | A | | 6/1954 | Johnson | |
| 2,682,917 | A | | 7/1954 | Schultz | |
| 2,745,467 | A | * | 5/1956 | Vale | 297/320 |
| 2,859,798 | A | | 11/1958 | Carte | |

(Continued)

*Primary Examiner* — Peter M Cuomo
*Assistant Examiner* — Ifeolu Adeboyejo
(74) *Attorney, Agent, or Firm* — Jackson Walker L.L.P.

(57) ABSTRACT

A sofa hinge that provides easy conversion of a sofa convertible from one position to another while providing added safety by substantially reducing the risk of an injury to the operator's fingers. The sofa hinge includes a first and a second bracket rotatably connected to the sofa hinge at a bolt. The sofa hinge further comprises a lever gear mechanism connected to the first bracket via a first lever latch on the first bracket. The lever gear mechanism is connected to the second bracket via a second lever latch on the second bracket. The first bracket has cover plates on both the inside and outside surfaces of the bracket. The second bracket includes a cover plate attached on the outside surface. The second lever latch can larger than the first lever latch and function as an additional cover plate on the inside surface of the sofa hinge. By having the cover plates and second lever latch cover the lever gear mechanism of the sofa hinge on both the outside and inside surfaces of the sofa hinge, the risk of injury to the operator's fingers is substantially reduced.

20 Claims, 15 Drawing Sheets

(56) References Cited

U.S. PATENT DOCUMENTS

| | | | | |
|---|---|---|---|---|
| 2,939,156 | A | 6/1960 | Fox | |
| 3,913,152 | A | 10/1975 | Quakenbush | |
| 4,099,768 | A * | 7/1978 | Amos | 297/63 |
| 4,318,568 | A | 3/1982 | Ericsson | |
| 4,608,722 | A | 9/1986 | Zorzetto | |
| 4,654,902 | A | 4/1987 | Shrock et al. | |
| 5,146,640 | A | 9/1992 | Barton et al. | |
| 5,153,952 | A | 10/1992 | Barton et al. | |
| 6,209,154 | B1 | 4/2001 | Huang | |
| 6,427,262 | B1 | 8/2002 | Huang | |
| 6,651,274 | B2 | 11/2003 | Swihart et al. | |
| 2004/0034928 | A1 * | 2/2004 | Patella | 5/13 |
| 2004/0216277 | A1 * | 11/2004 | Beaver | 16/324 |

* cited by examiner

MULTI-LEVEL SOFA HINGE FOR SOFA CONVERTIBLE

CROSS-REFERENCE TO RELATED APPLICATIONS

The present patent application is a continuation-in-part of a previously filed patent application, U.S. patent application Ser. No. 14/531,667 filed Nov. 3, 2014, which is a continuation-in-part of a previously filed application U.S. patent application Ser. No. 12/860,965, filed Aug. 23, 2010, now issued as U.S. Pat. No. 8,875,321, the entirety of which are hereby incorporated by reference.

TECHNICAL FIELD

The present invention relates to sofas, and more particularly to a sofa hinge used for converting a sofa into multiple positions.

BACKGROUND OF THE INVENTION

This section provides background information to facilitate a better understanding of the various aspects of the present invention. It should be understood that the statements in this section of this document are to be read in this light, and not as admissions of prior art.

A sofa is an upholstered item of furniture for the comfortable seating of more than one person and typically has an armrest on both sides of the sofa along with a back rest. Sofas are usually to be found in the family room, living room, den or the lounge. They are covered in a variety of textiles or in leather.

Sofas may be designed to be convertible into different positions, such as a lounge position or a bed position in addition to the sofa position. A hinge, which connects the sofa seat with the back rest of the sofa, is used to mechanically allow the operator of the sofa to switch the sofa from one position to another. Often, a hinge is placed on each side of the sofa. Hinges that are used to convert a sofa into multiple positions may be referred to as a "click clack mechanism" due to the clicking sound that is made when the sofa is converted into a new position.

Currently, the design of these types of hinges includes an exposed gear mechanism which may potentially snap an operator's finger while the operator transitions the sofa from one position to another.

Therefore, there is a need in the art for a sofa hinge that provides easy conversion of the sofa from one position to another while providing added safety by substantially reducing the risk of an injury to the operator's fingers.

BRIEF SUMMARY OF THE INVENTION

In one embodiment of the present invention, a sofa hinge comprises a first bracket and a second bracket, where the second bracket comprises a semi-circular portion and where the first and second brackets are rotatably connected together via a first bolt. The sofa hinge further comprises a lever connected to the first bracket via a first lever latch on the first bracket. The lever is connected to the second bracket via a second lever latch on the second bracket. Additionally, the lever comprises a plurality of notches, where the first lever latch is bolted to an end of the lever and where the second lever latch comprises a pin used to select one of the plurality of notches of the lever to select a position of a sofa. In addition, the sofa hinge comprises a cover plate rotatably connected to the first bolt, where the cover plate comprises a semi-circular portion and where the cover plate covers at least a portion of the semi-circular portion of the second bracket in various positions of the sofa. Furthermore, the semi-circular portion of the second bracket covers a portion of the lever in various positions of the sofa.

In another embodiment of the present invention, a sofa comprises a sofa seat and a back rest. Furthermore, the sofa comprises a hinge rotatably connecting the sofa seat with the back rest. The sofa hinge comprises a first bracket and a second bracket, where the second bracket comprises a semi-circular portion and where the first and second brackets are rotatably connected together via a first bolt. The sofa hinge further comprises a lever connected to the first bracket via a first lever latch on the first bracket. The lever is connected to the second bracket via a second lever latch on the second bracket. Additionally, the lever comprises a plurality of notches, where the first lever latch is bolted to an end of the lever and where the second lever latch comprises a pin used to select one of the plurality of notches of the lever to select a position of the sofa. In addition, the sofa hinge comprises a cover plate rotatably connected to the first bolt, where the cover plate comprises a semi-circular portion and where the cover plate covers at least a portion of the semi-circular portion of the second bracket in various positions of the sofa. Furthermore, the semi-circular portion of the second bracket covers a portion of the lever in various positions of the sofa.

Another embodiment of the present invention covers the inside surface of the sofa hinge such that an operator's fingers are protected against the gear mechanism of the sofa hinge. The inside surface of an embodiment of the sofa hinge comprises an inside cover plate connected to the first bracket. The second lever latch can be enlarged, in comparison to the first lever latch, so that it extends in a direction towards and partially overlaps the first lever latch, thereby functioning as an additional cover plate on the inside surface of the sofa hinge. The enlarged second lever latch also overlaps the inside surface of the inside cover plate connected to the first bracket. In this embodiment, the first lever latch, second lever latch, and inside cover plate lie in different vertical planes. The inside cover plate and enlarged second lever latch provide protection on the inside surface of sofa hinge of an operator's fingers from the internal gear mechanism of the sofa hinge.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWING

A better understanding of the present invention can be obtained when the following detailed description is considered in conjunction with the following drawings, in which.

DETAILED DESCRIPTION OF THE INVENTION

The present invention comprises a sofa hinge that includes a first and a second bracket rotatably connected to the sofa hinge at a bolt. The second bracket includes a semi-circular portion that covers a portion of the lever during the various positions (e.g., lounge, sofa, sofa bed) of the sofa. The lever is bolted to the first and second brackets via a first and second lever latch on the first and second bracket, respectively. The second lever latch includes a pin which is used to select a particular notch of the lever to select a position of the sofa. The sofa hinge further includes a cover plate rotatably connected to the sofa hinge at the bolt. The cover plate includes a semi-circular portion and is adjacent to the semi-circular portion of the second bracket. The cover plate covers at least a portion of the semi-circular portion of the second bracket in various positions of the sofa. By having the cover plate conceal the gear mechanism of the sofa hinge, the risk of injury to the operator's fingers is substantially reduced.

It is to be understood that the following disclosure provides many different embodiments, or examples, for implementing different features of various embodiments. Specific examples of components and arrangements are described below to simplify the patent disclosure. These are, of course, merely examples and are not intended to be limiting.

As discussed in the Background section, currently, the design of click-clack mechanisms includes an exposed gear mechanism which may potentially snap an operator's finger while the operator transitions the sofa from one position to another. Therefore, there is a need in the art for a sofa hinge that provides easy conversion of the sofa from one position to another while providing added safety by substantially reducing the risk of an injury to the operator's fingers.

Figure 1:
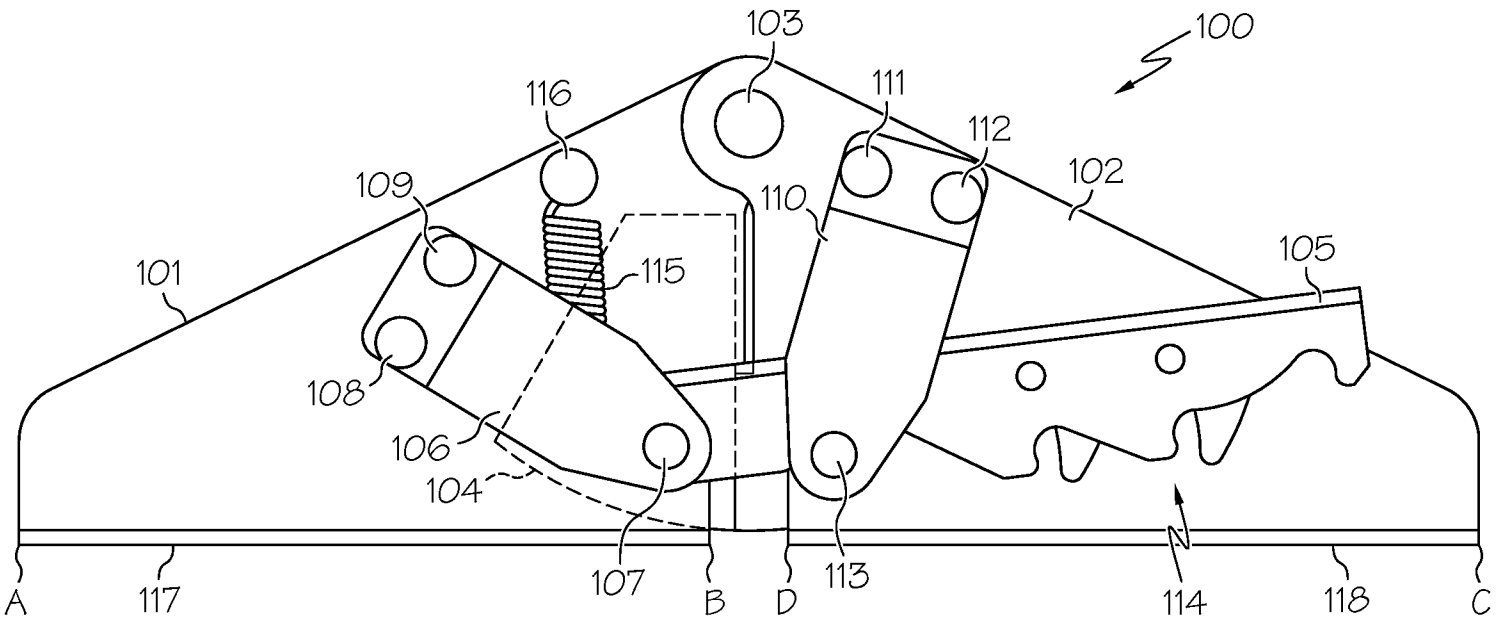
FIG. 1 is a side view of a multi-level sofa hinge for a sofa convertible in accordance with an embodiment of the present invention.
Figure 2:
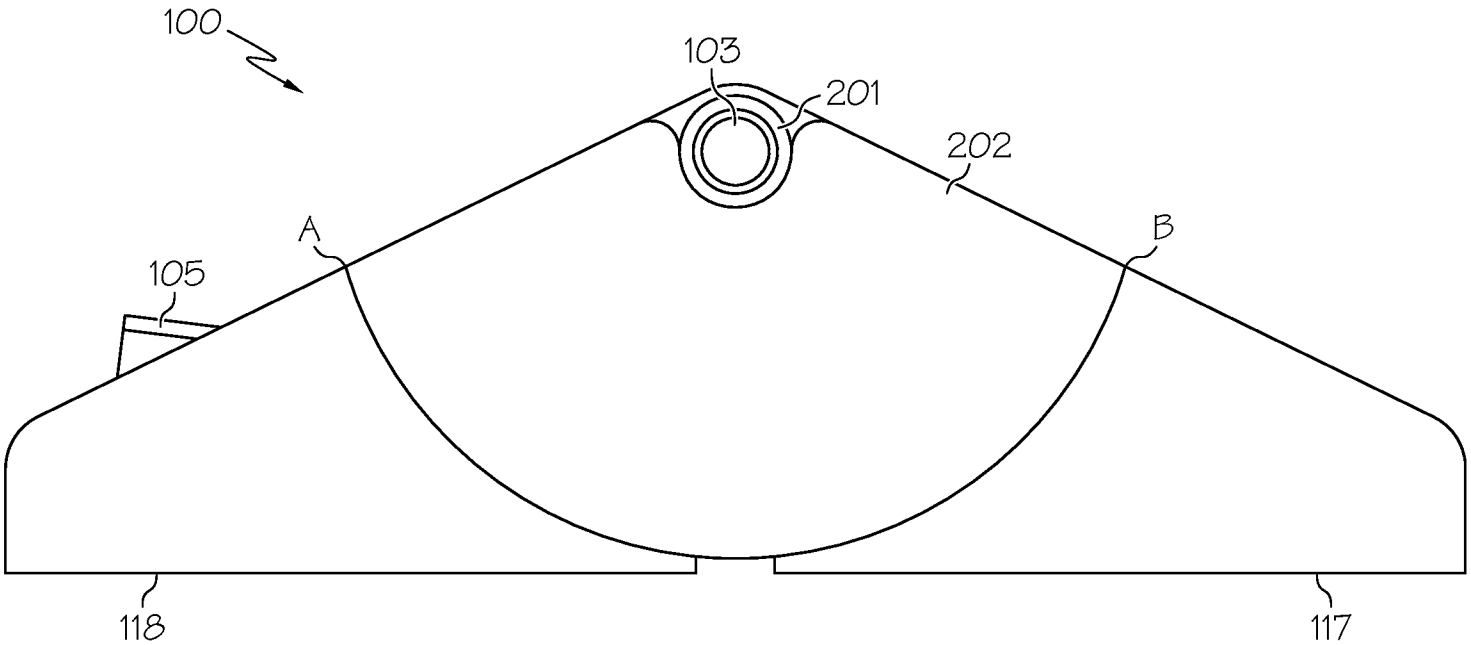
FIG. 2 illustrates an external view of the multi-level sofa hinge for a sofa convertible in accordance with an embodiment of the present invention.
Figure 3A:
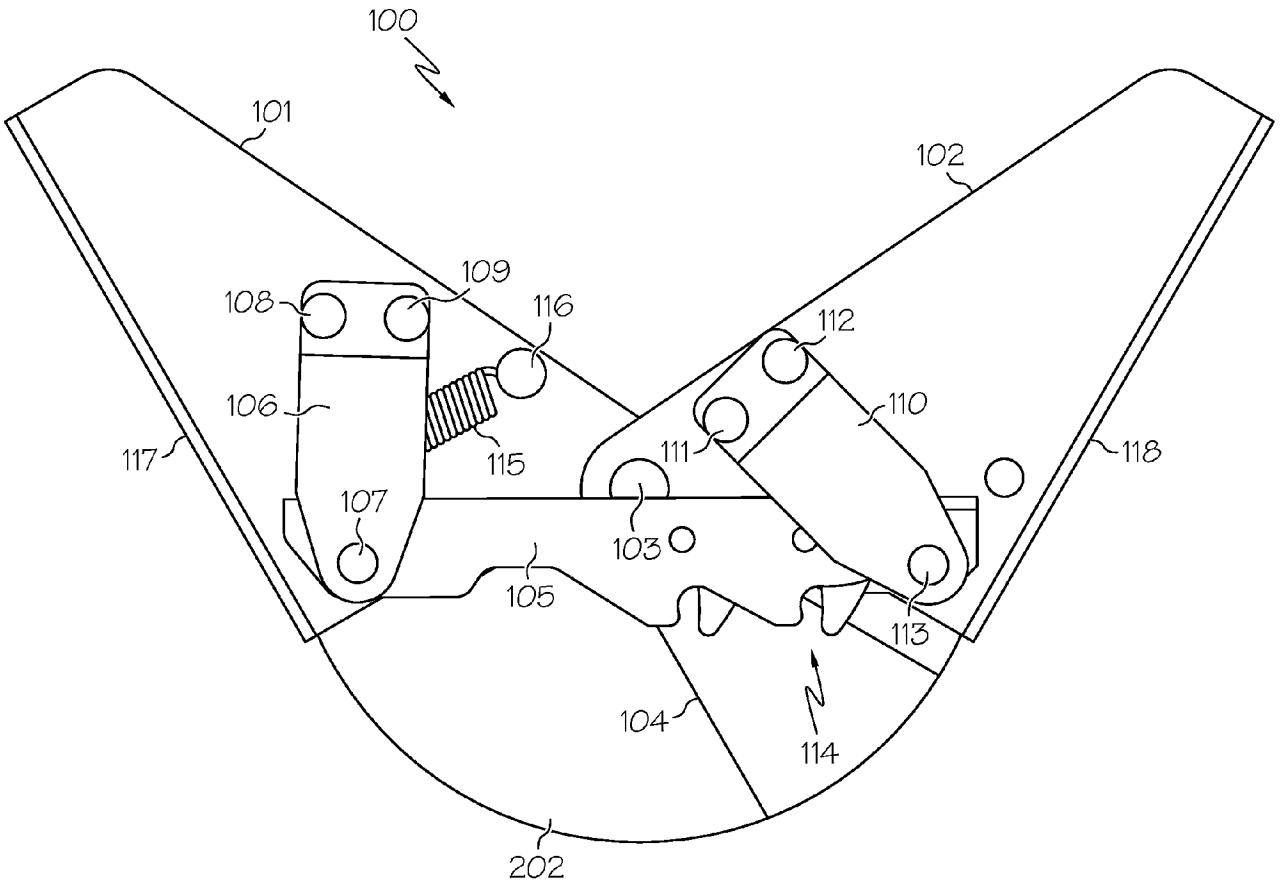
FIGS. 3A-3B illustrate a sofa hinge a sofa according to one or more aspects of the present invention in a released, or unlocked, position permitting the first bracket and second bracket, and therefore the back and seat platforms of the sofa, to move relative to one another.
Figure 3B:
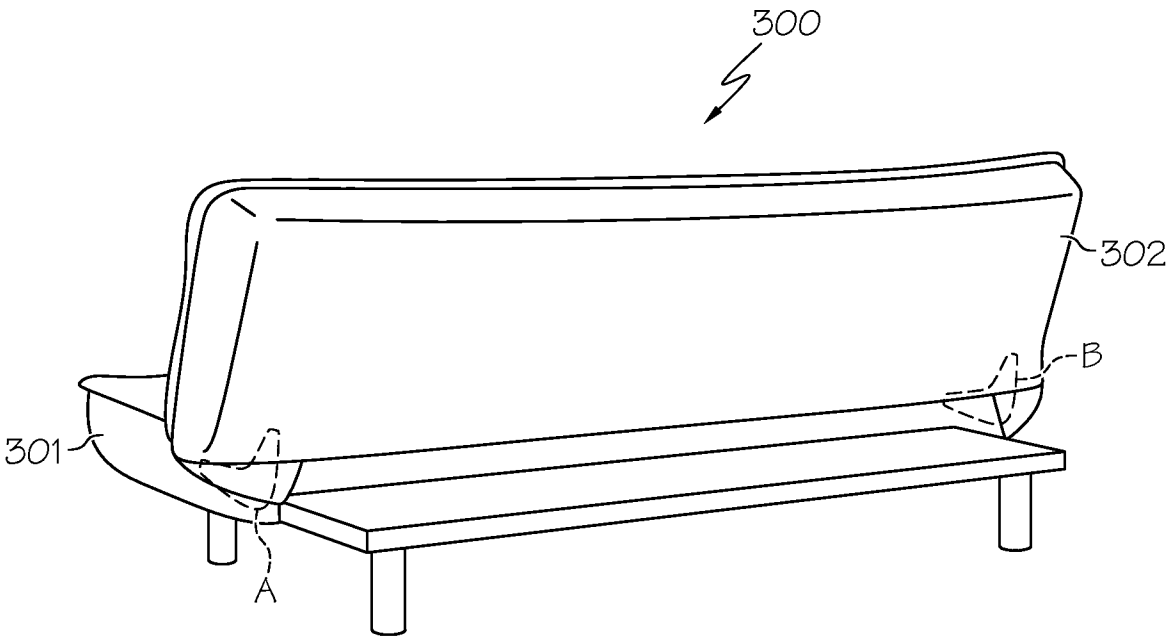
Figure 4A:
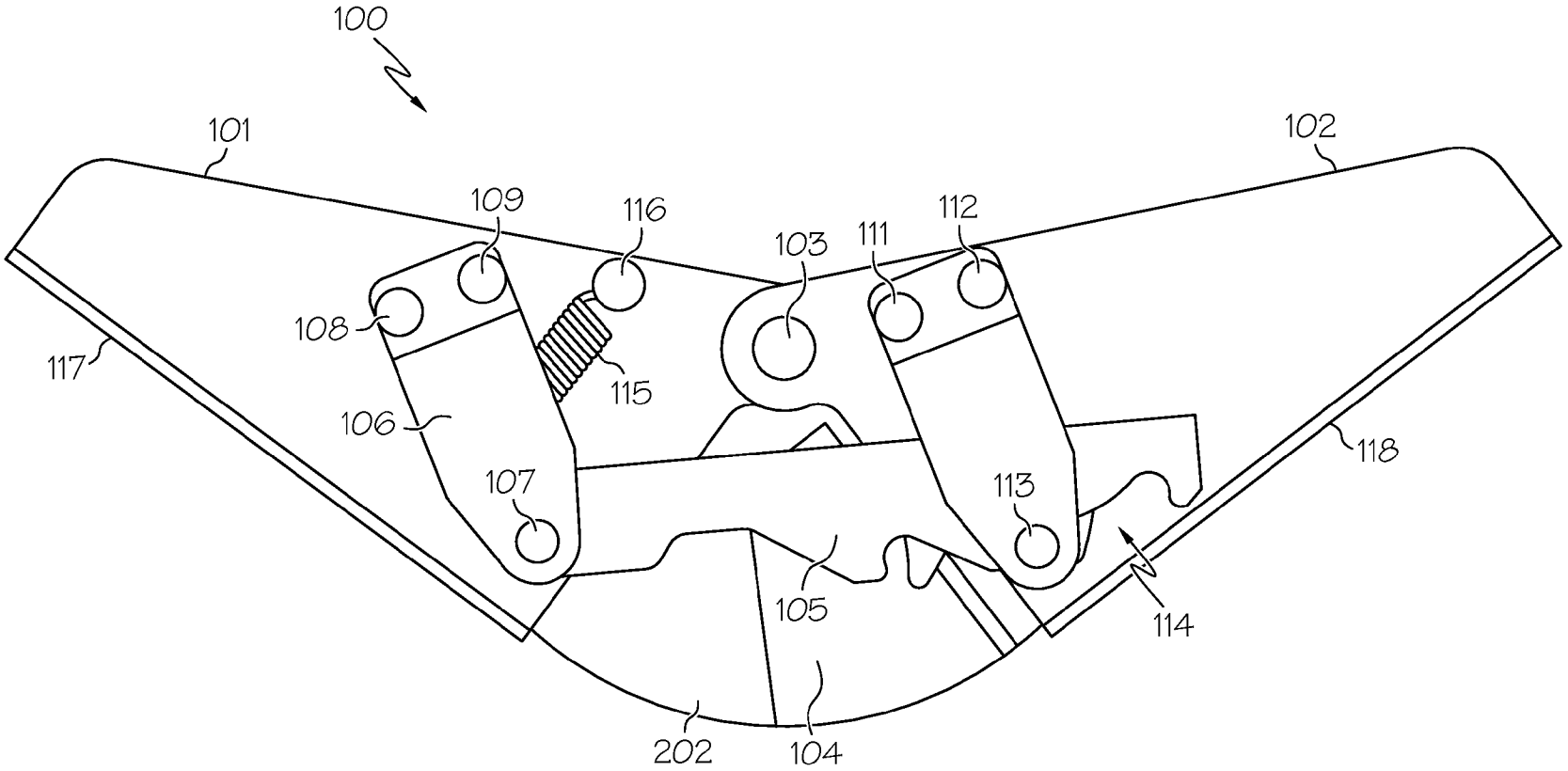
FIGS. 4A-4B illustrate a sofa hinge and a sofa secured in a sofa position in accordance with an embodiment of the present invention.
Figure 4B:
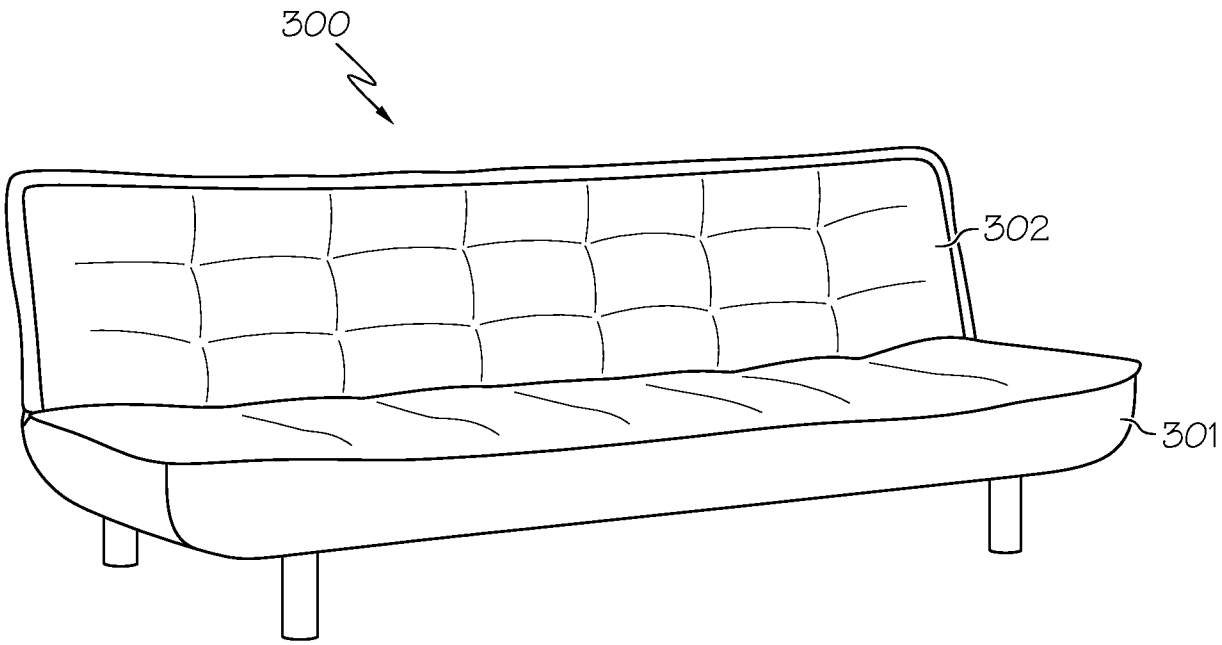
Figure 5A:
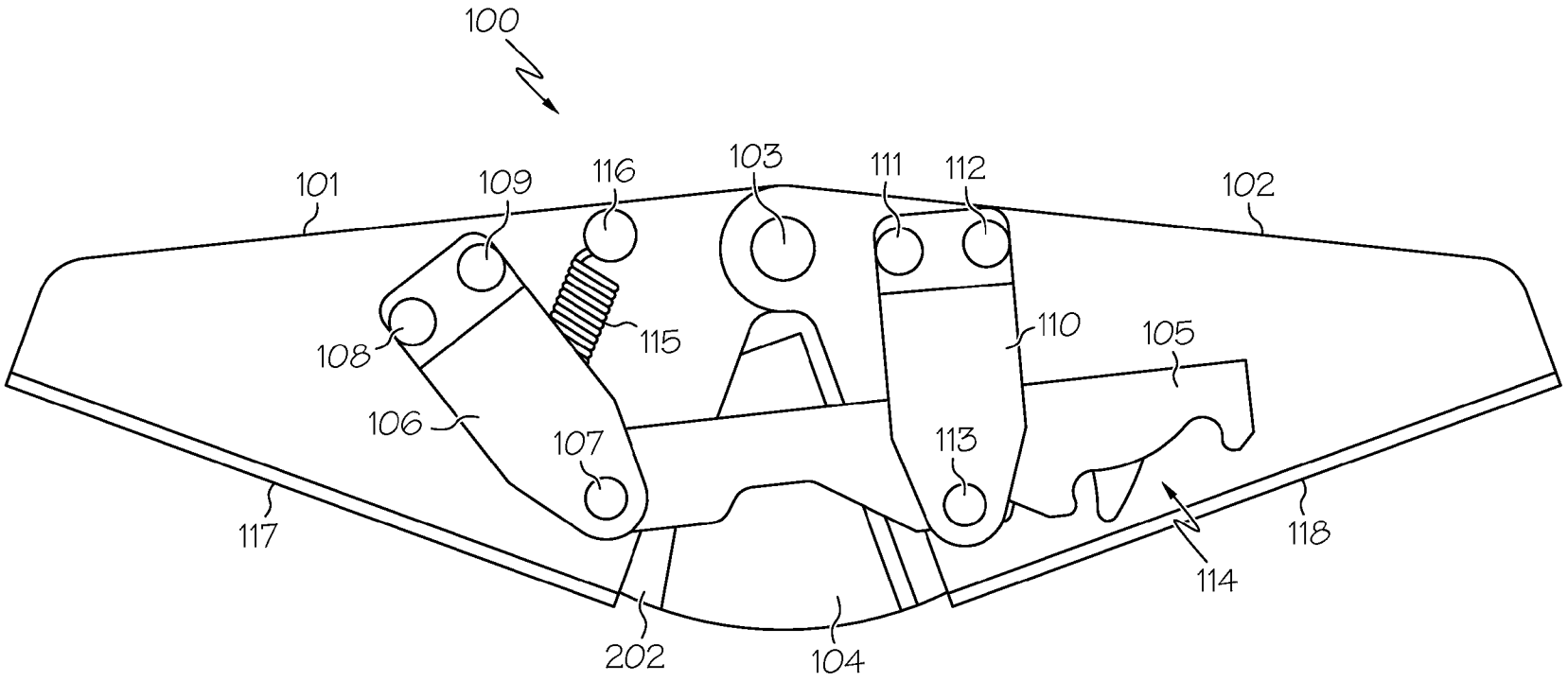
FIGS. 5A-5B illustrate a sofa hinge and a sofa secured in a lounge position in accordance with an embodiment of the present invention.
Figure 5B:
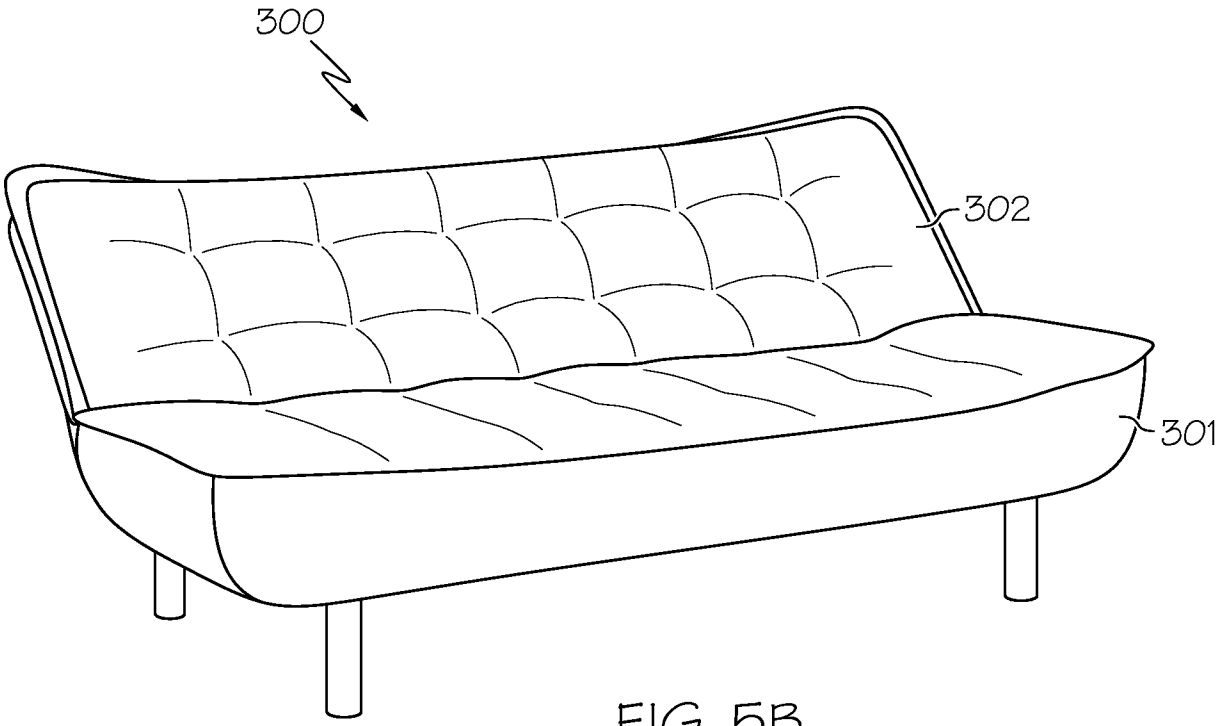
Figure 6A:
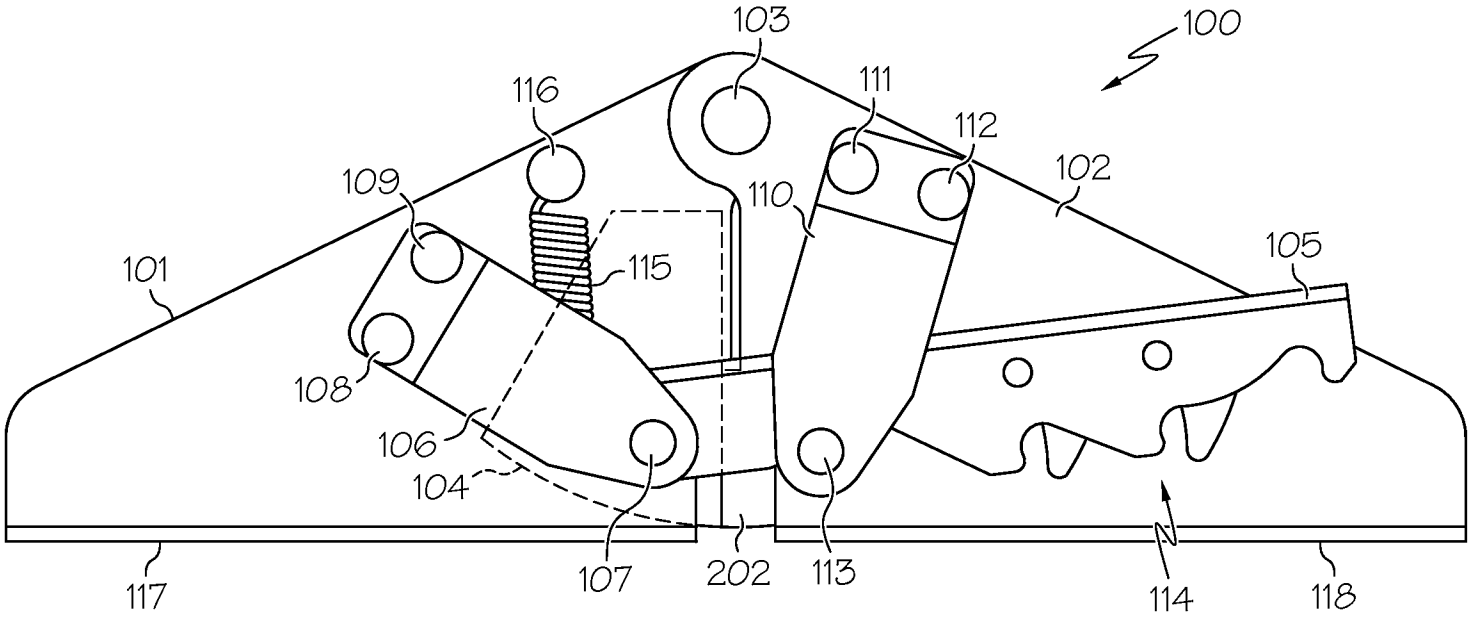
FIGS. 6A-6B illustrate a sofa hinge and a sofa secured in a sofa bed position in accordance with an embodiment of the present invention.
Figure 6B:
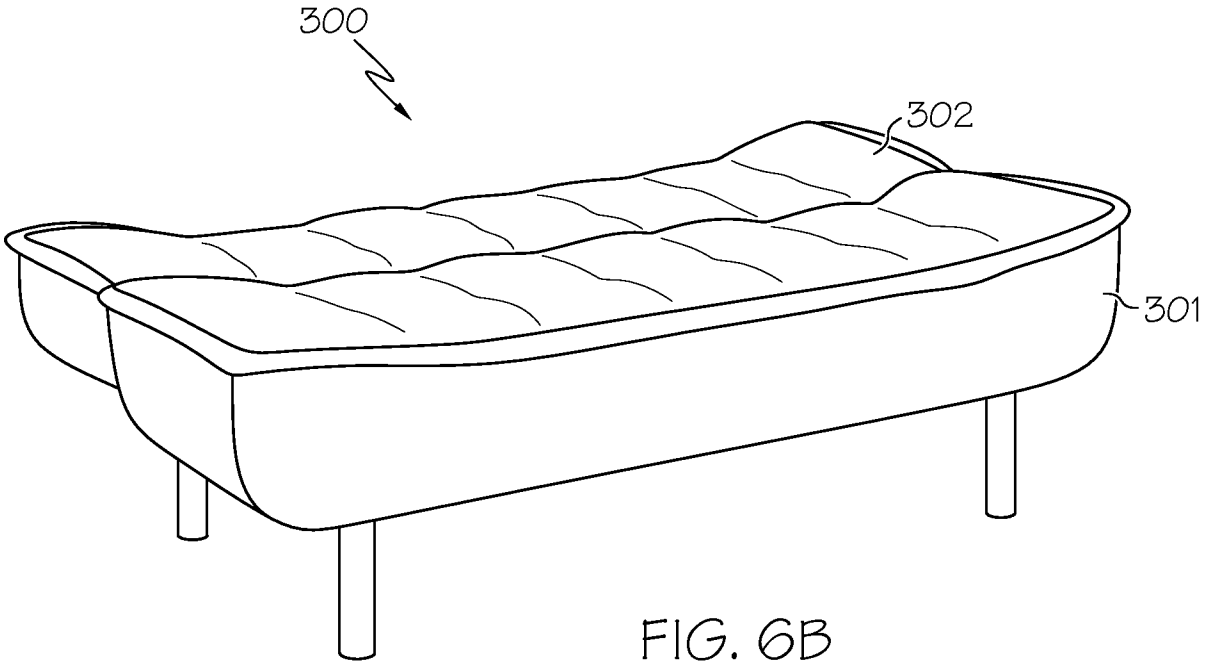

The sofa hinge of the present invention provides easy conversion of a sofa convertible from one position to another while providing added safety by substantially reducing the risk of injury to the operator's fingers as discussed below in connection with FIGS. 1-2, 3A-3B, 4A-4B, 5A-5B and 6A-6B. FIG. 1 is an internal view of the sofa hinge, which may also be referred to as a "click-clack mechanism." FIG. 2 illustrates an external view of the sofa hinge. FIGS. 3A-3B illustrate a sofa hinge and a sofa when the sofa is secured in the release position. FIGS. 4A-4B illustrate the sofa hinge and sofa when the sofa is secured in the sofa position. FIGS. 5A-5B illustrate the sofa hinge and sofa when the sofa is secured in the lounge position. FIGS. 6A-6B illustrate the sofa hinge and sofa when the sofa is secured in the sofa bed position.

Referring to FIG. 1, FIG. 1 is an internal view of a sofa hinge 100 in accordance with an embodiment of the preset invention. Sofa hinge 100 includes brackets 101, 102 which are rotatably connected together via a bolt 103. Bracket 102 further includes a semi-circular portion 104 which covers a portion of lever 105 (from an external perspective as shown in FIG. 2) during the various positions (e.g., lounge, sofa, and sofa bed) of the sofa.

Sofa hinge 100 further includes lever 105 which is connected to bracket 101 via a lever latch 106. In particular, lever latch 106 is bolted to lever 105 at one end of lever 105 at bolt 107. Lever latch 106 may be bolted to bracket 101 via bolts 108, 109.

Lever 105 is connected to bracket 102 via a lever latch 110. Lever latch 110 may be bolted to bracket 102 via bolts 111, 112. Furthermore, lever latch 110 includes a pin 113 used to select one of the notches 114 of lever 105 to select a position of the sofa. As pin 113 selects a particular notch 114 of lever 105, a "clicking" sound is heard which provides an indication to the operator that a new position of the sofa (e.g., lounge, sofa, sofa bed) has been established.

Additionally, sofa hinge 100 may include a spring 115 connected to an end of lever 105 where spring 115 is bolted to bracket 101 via bolt 116.

In one embodiment, the distance of bracket 101 from the end identified as "A" in FIG. 1 to bolt 113 is about 5½ inches in length. In one embodiment, bracket 101 includes a flap 117 extending from the end labeled as "A" in FIG. 1 to the end labeled as "B" in FIG. 1. In one embodiment, the distance of flap 117 from end A to end B is about 4¾ inches in length.

In one embodiment, the distance of lever 105 from bolt 107 to the opposite end of lever 105 is about 5 inches in length.

In one embodiment, the distance of bracket 102 from the end identified as "C" in FIG. 1 to bolt 113 is about 5½ inches in length. In one embodiment, bracket 102 includes a flap 118 extending from the end labeled as "C" in FIG. 1 to the end labeled as "D" in FIG. 1. In one embodiment, the distance of flap 118 from end C to end D is about 4¾ inches in length.

A description of the external view of sofa hinge 100 is provided below in connection with FIG. 2.

Referring to FIG. 2, in conjunction with FIG. 1, FIG. 2 illustrates an external view of sofa hinge 100 in accordance with an embodiment of the present invention. Components of sofa hinge 100 that are shown on both the internal (FIG. 1) and external (FIG. 2) views have the same identification number.

As illustrated in FIG. 2, sofa hinge 100 includes a cover plate 201 that includes a semi-circular portion 202. Cover plate 201 is rotatably connected to sofa hinge 100 via bolt 103. In one embodiment, cover plate 201 covers at least a portion of semi-circular portion 104 of bracket 102 in various positions of the sofa. By having cover plate 201 conceal the gear mechanism of sofa hinge 100, the risk of injury to the operator's fingers is substantially reduced.

In one embodiment, cover plate 201 is adjacent to semi-circular portion 104 of bracket 102. In one embodiment, the horizontal distance between the end labeled as "A" in FIG. 2 to the end labeled as "B" in FIG. 2 is about 5½ inches in length.

A description of the various configurations of sofa hinge 100 during the different positions of the sofa is described below in connection with FIGS. 3A-B, 4A-B, 5A-B and 6A-B.

Referring to FIG. 3A, in conjunction with FIGS. 1 and 2, FIG. 3A illustrates the configuration of sofa hinge 100 when the sofa (shown in FIG. 3B) is in the release position in accordance with an embodiment of the present invention. As illustrated in FIG. 3A, semi-circular portion 202 of cover plate 201 provides protection on the outside surface of sofa hinge 100 of an operator's fingers from the gear mechanism of sofa hinge 100.

Referring to FIG. 3B, FIG. 3B illustrates a sofa 300 when in the release position in accordance with an embodiment of the present invention. As illustrated in FIG. 3B, sofa hinge 100 may rotatably connect a sofa seat 301 with a back rest 302 residing in areas labeled as "A" and "B" in FIG. 3B.

Referring to FIGS. 4A-B, in conjunction with FIGS. 1 and 2, FIG. 4A illustrates the configuration of sofa hinge 100 when sofa 300 is in the sofa position as illustrated in FIG. 4B in accordance with an embodiment of the present invention. As illustrated in FIG. 4A, semi-circular portion 202 of cover plate 201 provides protection on the outside surface of sofa hinge 100 of an operator's fingers from the gear mechanism of sofa hinge 100.

Referring to FIGS. 5A-B, in conjunction with FIGS. 1 and 2, FIG. 5A illustrates the configuration of sofa hinge 100 when sofa 300 is in the lounge position as illustrated in FIG. 5B in accordance with an embodiment of the present invention.

Referring to FIGS. 6A-B, in conjunction with FIGS. 1 and 2, FIG. 6A illustrates the configuration of sofa hinge 100 when sofa 300 is in the sofa bed position as illustrated in FIG. 6B in accordance with an embodiment of the present invention.

Figure 7:
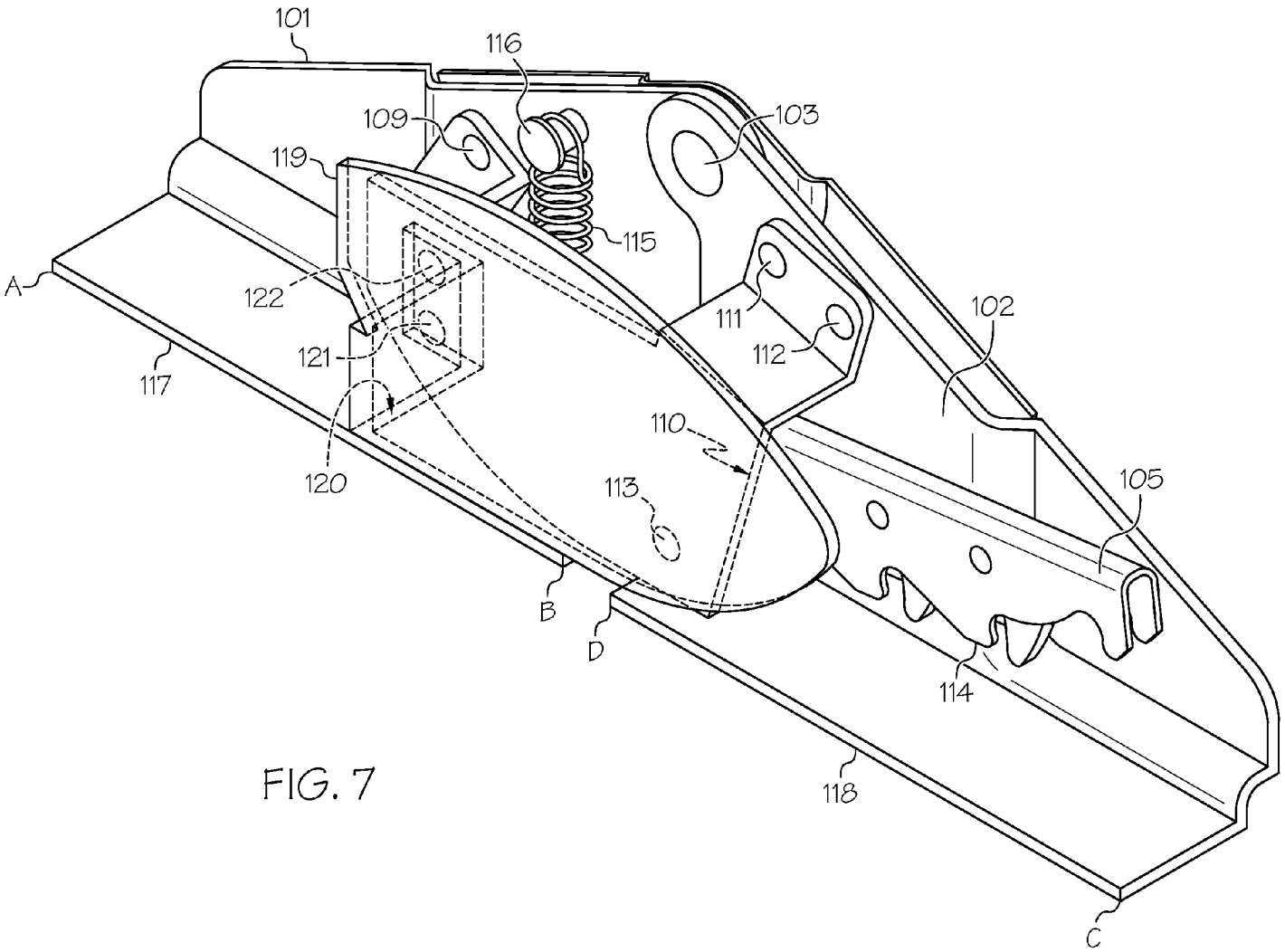
FIG. 7 is an elevation view of the back side of a multi-level sofa hinge for a sofa convertible in accordance with an embodiment of the present invention.

FIG. 7, in conjunction with FIGS. 1 and 2, illustrates another embodiment of the present invention providing protection on the inside surface of sofa hinge 100 of an operator's fingers from the gear mechanism of sofa hinge 100. FIG. 7 illustrates the inside surface of an embodiment of sofa hinge 100 comprising an inside cover plate 119 connected to bracket 101 via bolts 121, 122 in accordance with an embodiment of the present invention. In one exemplary embodiment of the present disclosure, inside cover plate 119 further comprises an extension 120 allowing inside cover plate 119 to be spaced away from bracket 101. In one embodiment, inside cover plate 119 can be molded, bolted, welded, nailed, screwed, or fastened in any other conventional method to bracket 101.

Figure 8:
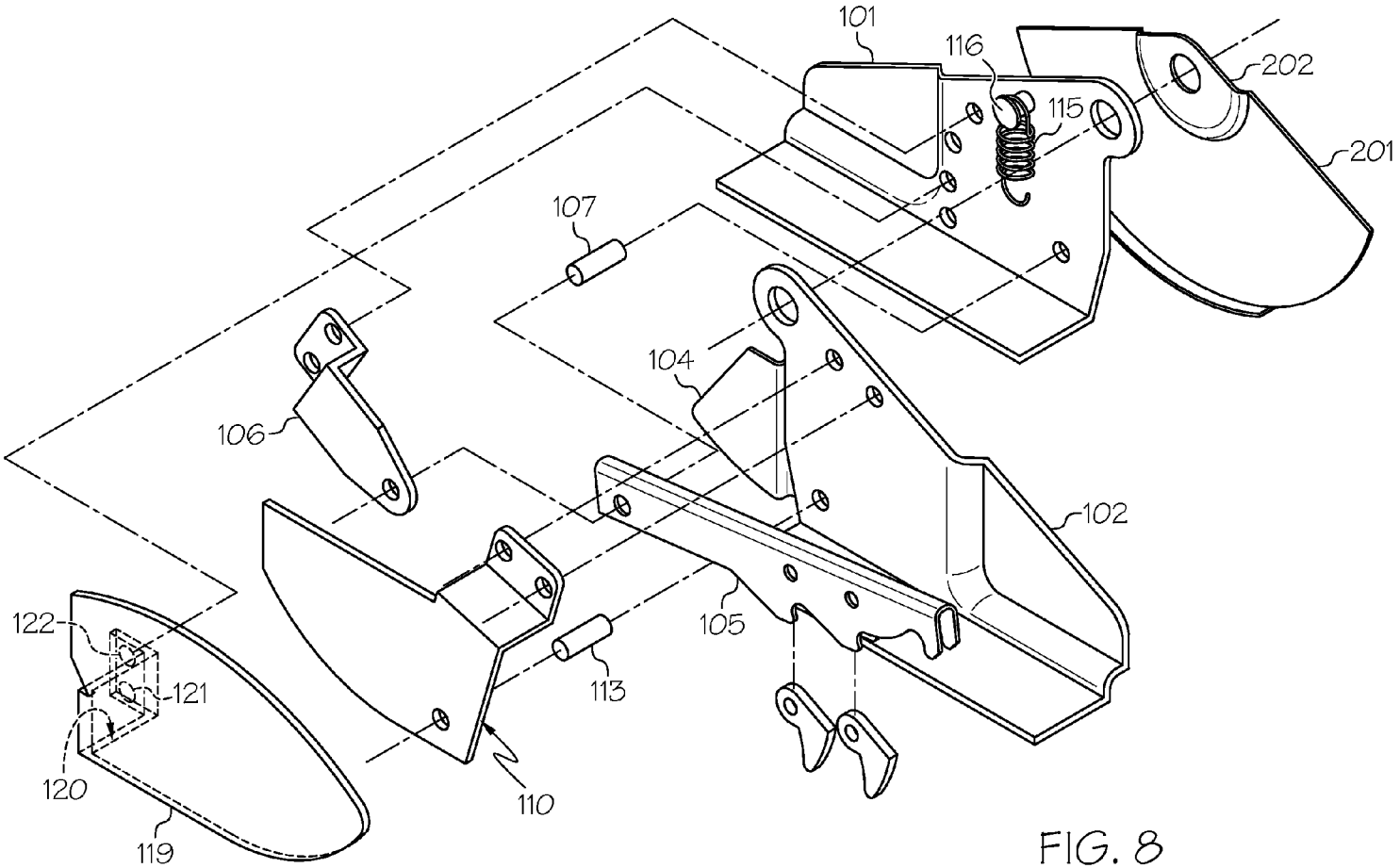
FIG. 8 illustrates an exploded view of a sofa hinge in accordance with an embodiment of the present invention.

In one embodiment, as illustrated in FIGS. 7 and 8 in comparison to FIG. 1, lever latch 110 is enlarged, in comparison to lever latch 106, so that it extends in a direction towards and partially overlaps lever latch 106, thereby functioning as an additional cover plate on the inside of surface of sofa hinge 100. Enlarged lever latch 110 also overlaps the inside surface of inside cover plate 119. In this embodiment, lever latch 106, lever latch 110, and inside cover plate 119 lie in different vertical planes. As illustrated in FIG. 7, inside cover plate 119 and lever latch 110 provide protection on the inside surface of sofa hinge 100 of an operator's fingers from the internal gear mechanism of sofa hinge 100.

Referring to FIG. 8, in conjunction with FIGS. 1, 2, and 7, FIG. 8 illustrates the exploded view of the components assembled to form sofa hinge 100 in accordance with an embodiment of the present invention.

Figure 9:
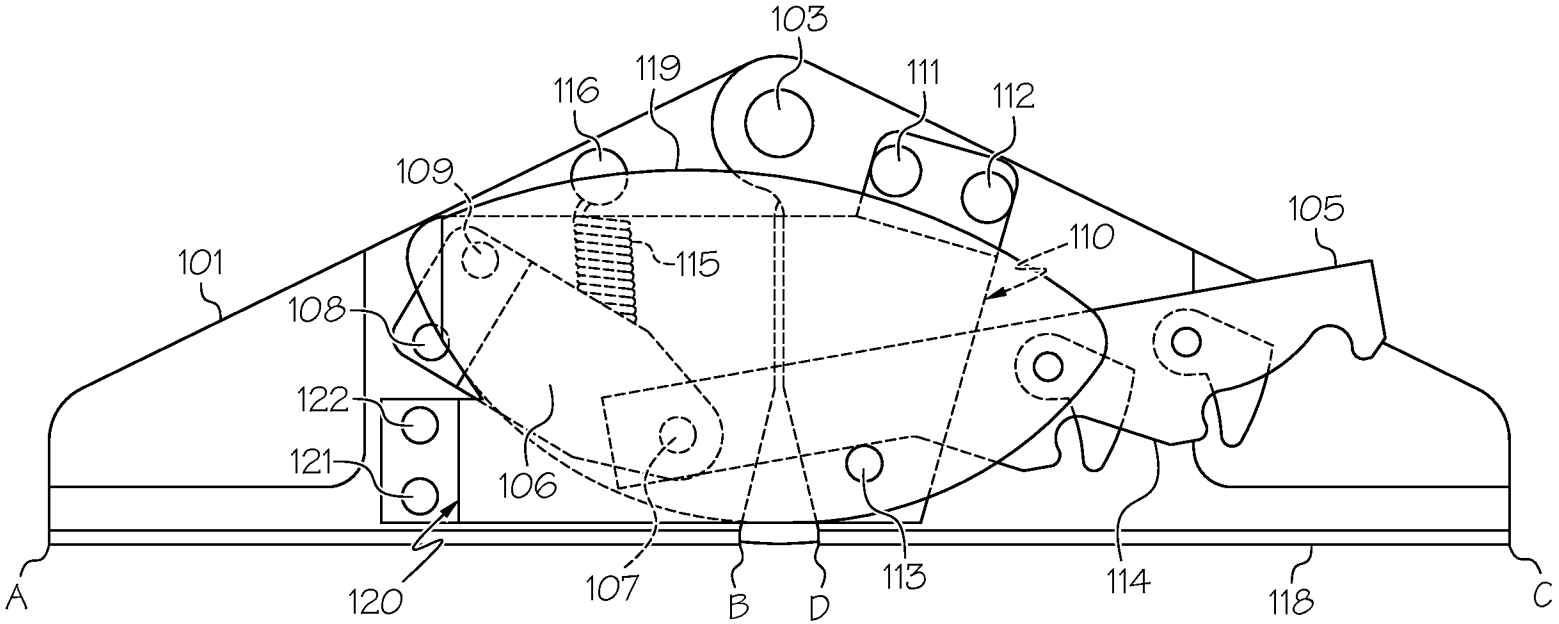
FIG. 9 illustrates a side view of the back side of a sofa hinge secured in a sofa bed position in accordance with an embodiment of the present invention.

Referring to FIG. 9, in conjunction with FIGS. 1, 2, and 7, FIG. 9 illustrates sofa hinge 100 secured in a sofa bed position in accordance with an embodiment of the present invention. As illustrated in FIG. 9, inside cover plate 119 and lever latch 110 provide protection on the inside surface of sofa hinge 100 of an operator's fingers from the internal gear mechanism of sofa hinge 100.

Figure 10:
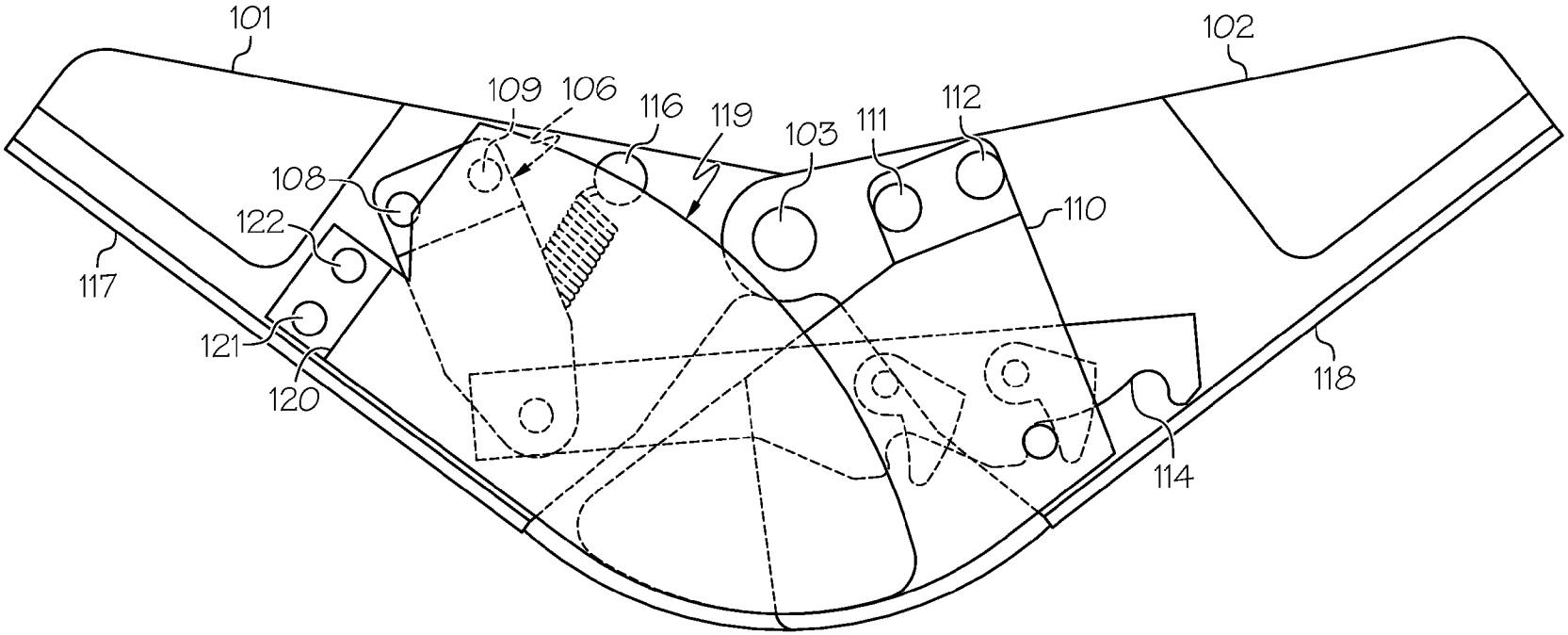
FIG. 10 illustrates a side view of the back side of a sofa hinge secured in a sofa position in accordance with an embodiment of the present invention.

Referring to FIG. 10, in conjunction with FIGS. 1, 2, and 7, illustrates sofa hinge 100 secured in a sofa position in accordance with an embodiment of the present invention. As illustrated in FIG. 10, inside cover plate 119 and lever latch 110 provide protection on the inside surface of sofa hinge 100 of an operator's fingers from the internal gear mechanism of sofa hinge 100.

Figure 11:
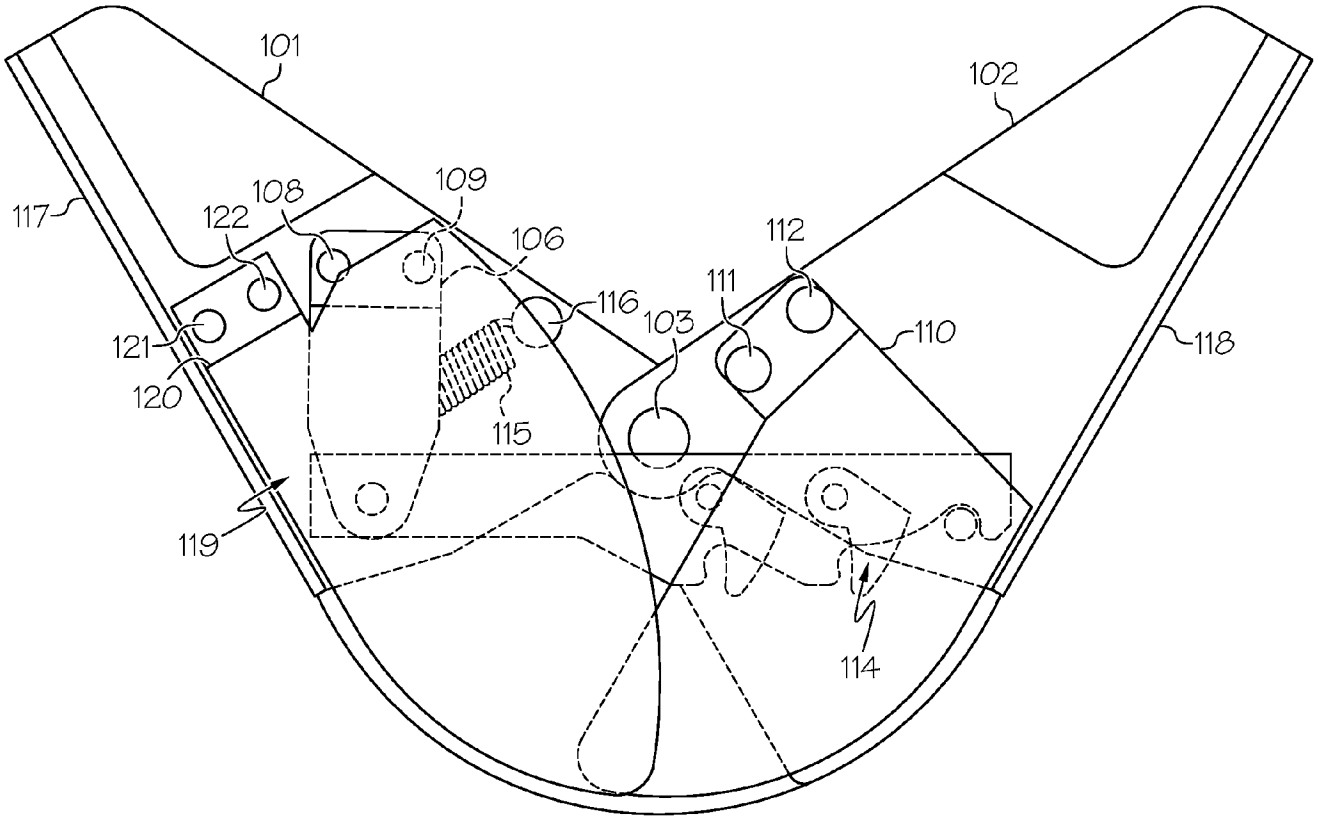
FIG. 11 illustrates a side view of the back side of a sofa hinge according to one or more aspects of the present invention in a released, or unlocked, position permitting a first bracket and second bracket to move relative to one another.

Referring to FIG. 11, in conjunction with FIGS. 1, 2, and 7, illustrates a sofa hinge according to one or more aspects of the present invention in a released, or unlocked, position permitting the first bracket and second bracket to move relative to one another. As illustrated in FIG. 11, inside cover plate 119 and lever latch 110 provide protection on the inside surface of sofa hinge 100 of an operator's fingers from the internal gear mechanism of sofa hinge 100.

Although the sofa and sofa hinge are described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims.

The invention claimed is:

1. A sofa-bed hinge, comprising:

a first bracket having a first edge side and an inside surface, wherein said inside surface of said first bracket is integrally formed with a first cover plate section;

a second bracket having a first edge side and an outside surface, wherein said outside surface of said second bracket is integrally formed with a second cover plate section, and wherein said first and second brackets are rotatably connected together via a first bolt;

a lever connected to an inside surface of said first bracket via a first lever latch on said first bracket, wherein said lever is connected to an inside surface of said second bracket via a second lever latch on said second bracket, wherein said lever comprises a plurality of notches, wherein said first lever latch is bolted to an end of said lever, wherein said second lever latch comprises a pin used to select one of said plurality of notches of said lever to select a position of a sofa-bed, wherein said first edge sides of said first and second brackets abut when said lever is in a bed position, wherein said first cover plate section and said second cover plate section cover a portion of said first bracket and said lever when said lever is in said bed position, and wherein as said lever changes from said bed position to a sofa position, said first bracket moves away from said second bracket, thereby creating a space between said first edge sides of said brackets; and a third cover plate affixed to an outside surface of said first bracket, and rotatably connected to said second bracket via said first bolt, wherein when said second bracket rotates away from said first bracket, said third cover plate remains stationary and covers at least a portion of said space between said first edge sides of said brackets, and wherein said first cover plate section, second cover plate section, said third cover plate, and said first edge side of said first bracket lie in different vertical planes.

2. The sofa-bed hinge as recited in claim 1 further comprising: a spring connected to said end of said lever, wherein said spring is bolted to said first bracket.

3. The sofa-bed hinge as recited in claim 1, wherein said positions of said sofa-bed comprise a release position, said sofa position, a lounge position and said bed position.

4. The sofa-bed hinge as recited in claim 1, wherein said third cover plate is semi-circular in shape and has a center point, wherein said third cover plate is connected to said first bracket, via said first bolt, in close proximity to said center point.

5. The sofa-bed hinge as recited in claim 1, wherein said second bracket is integrally formed with said second cover plate section by affixing said section to a surface of said second bracket in close proximity to said first edge side of said second bracket.

6. The sofa-bed hinge as recited in claim 1, wherein said third cover plate covers a portion of said second bracket and said lever when said lever is in said bed position.

7. The sofa-bed hinge as recited in claim 1, wherein said second lever latch is larger than said first lever latch, and said latches lie in different vertical planes.

8. The sofa-bed hinge as recited in claim 1, wherein said second lever latch covers a portion of said inside surface of said first bracket and said first lever latch when said lever is in said bed position.

9. The sofa-bed hinge as recited in claim 1, wherein said first cover plate section, second cover plate section, third cover plate, first edge side of said first bracket, first lever latch and second lever latch lie in different vertical planes.

10. A sofa-bed, comprising:

a sofa seat;

a back rest;

a sofa-bed hinge rotatably connecting said sofa seat with said back rest, wherein said sofa-bed hinge comprises:

a first bracket having a first edge side and an inside surface, wherein said inside surface of said first bracket is integrally formed with a first cover plate section;

a second bracket having a first edge side and an outside surface, wherein said outside surface of second bracket is integrally formed with a second cover plate section, and wherein said first and second brackets are rotatably connected together via a first bolt;

a lever connected to an inside surface of said first bracket via a first lever latch on said first bracket, wherein said lever is connected to an inside surface of said second bracket via a second lever latch on said second bracket, wherein said lever comprises a plurality of notches, wherein said first lever latch is bolted to an end of said lever, wherein said second lever latch comprises a pin used to select one of said plurality of notches of said lever to select a position of said sofa-bed, wherein said first edge sides of said first and second brackets abut when said lever is in a bed position, wherein said first cover plate section and second cover plate section cover a portion of said first bracket and said lever when said lever is in said bed position, and wherein as said lever changes from said bed position to a sofa position, said first bracket moves away from said second bracket, thereby creating a space between said first edge sides of said brackets;

and a third cover plate affixed to an outside surface of said first bracket and rotatably connected to said second bracket via said first bolt, and wherein when said second bracket rotates away from said first bracket, said third cover plate remains stationary and covers at least a portion of said space between said first edge sides of said brackets, and wherein said first cover plate section, second cover plate section, said third cover plate, and said first edge side of said first bracket lie in different vertical planes.

11. The sofa-bed as recited in claim 10, wherein said positions of said sofa-bed comprise a release position, said sofa position, a lounge position and said bed position.

12. The sofa-bed as recited in claim 10, wherein said third cover plate of said sofa-bed hinge is semi-circular in shape and has a center point, wherein said third cover plate is connected to said first bracket, via said first bolt, in close proximity to said center point.

13. The sofa-bed hinge as recited in claim 12, wherein said second and third cover plates together form a semi-circular shape when said lever changes from said bed position to said release position.

14. The sofa-bed as recited in claim 10, wherein said second bracket is integrally formed with said second cover plate section by affixing said section to a surface of said second bracket in close proximity to said first edge side of said second bracket.

15. The sofa-bed as recited in claim 14, wherein said second cover plate section is semi-circular in shape.

16. The sofa-bed as recited in claim 10, wherein said third cover plate covers a portion of said second bracket and said lever when said lever is in said bed position.

17. The sofa-bed as recited in claim 10, wherein said second lever latch is larger than said first lever latch, and said latches lie in different vertical planes.

18. The sofa-bed hinge as recited in claim 10, wherein said second lever latch covers a portion of said inside surface of said first bracket and said first lever latch when said lever is in said bed position.

19. The sofa-bed hinge as recited in claim 10, wherein said first cover plate section, second cover plate section, third cover plate, first edge side of said first bracket, first lever latch and second lever latch lie in different vertical planes.

20. The sofa-bed hinge as recited in claim 17, wherein said second lever latch covers a portion of said inside surface of said first bracket and said first lever latch when said lever is in said bed position.

* * * * *